US007173206B2

(12) United States Patent
Du Pont

(10) Patent No.: US 7,173,206 B2
(45) Date of Patent: Feb. 6, 2007

(54) SEALED SOFT SWITCH ASSEMBLIES

(75) Inventor: Ronal Charles Du Pont, Oakville (CA)

(73) Assignee: Tyco Electronics Canada Ltd., Markham (CA)

( * ) Notice: Subject to any disclaimer, the term of this patent is extended or adjusted under 35 U.S.C. 154(b) by 21 days.

(21) Appl. No.: 11/112,889

(22) Filed: Apr. 22, 2005

(65) Prior Publication Data

US 2006/0237295 A1 Oct. 26, 2006

(51) Int. Cl.
*H01H 5/18* (2006.01)

(52) U.S. Cl. ..... 200/406; 200/405; 439/690

(58) Field of Classification Search ..... 200/405, 200/406

See application file for complete search history.

(56) References Cited

U.S. PATENT DOCUMENTS

| | | | | |
|---|---|---|---|---|
| 3,591,740 A | | 7/1971 | Kolster | |
| 4,427,006 A | * | 1/1984 | Nottke | 606/42 |
| 4,719,322 A | | 1/1988 | Guzik et al. | |
| 5,444,605 A | | 8/1995 | Rivera | |
| 5,727,675 A | | 3/1998 | Leveque et al. | |
| 6,423,911 B2 | * | 7/2002 | Yoshida et al. | 200/6 A |
| 6,552,287 B2 | | 4/2003 | Janniere | 200/406 |
| 6,747,218 B2 | | 6/2004 | Huseman et al. | 200/1 B |
| 6,906,275 B2 | * | 6/2005 | Koyama et al. | 200/516 |
| 2003/0029710 A1 | * | 2/2003 | Spedale et al. | 200/553 |

FOREIGN PATENT DOCUMENTS

| | | |
|---|---|---|
| EP | 0 756 300 | 1/1997 |

* cited by examiner

*Primary Examiner*—Elvin Enad
*Assistant Examiner*—Lheiren Mae A. Anglo

(57) ABSTRACT

A switch assembly is provided which includes a holder defining at least a pair of eyelets extending completely therethrough; an electrically conductive lead-frame supported on the holder, the lead-frame defining at least a pair of openings therein; and at least a pair of electrically conductive rivets each configured and adapted for at least partial positioning in a respective eyelet. The first opening of the lead-frame is larger than a head portion of a first rivet such that the head portion does not contact the lead-frame. The second opening of the lead-frame is smaller than a head portion of another rivet such that the head portion contacts the lead-frame. The switch assembly further includes at least one electrically conductive snap dome in electrical contact with the lead-frame and overlying the first rivet.

20 Claims, 8 Drawing Sheets

SEALED SOFT SWITCH ASSEMBLIES

BACKGROUND

1. Technical Field

The present disclosure relates to electrical switches and, more particularly, to sealed soft switch assemblies including snap domes and the like.

2. Background of Related Art

A wide variety of instruments and equipment exist which incorporate switches and the like which provide tactile and/or audible feedback, such as, for example, a feedback membrane switch or snap dome switch. Typically, the electrical contacts of such switches include an electrically conductive film disposed on an electrically insulative substrate (e.g., a printed circuit board). The electrically conductive film defines the outer contact for the outer legs of the snap dome and the center contact for the center of the snap dome.

Typically, the placement of snap domes, and the necessary spacers and membranes on a printed circuit board, is a tedious process. Additionally, space limitations in switches including printed circuit boards reduces the ability to use larger snap domes in the switch and the ability to create switches with improved tactile feedback.

Accordingly, the need exists for switches and assemblies which reduce the labor costs associated with the production thereof.

A need exists for switches and assemblies which exhibit improved tactile feedback characteristics.

A need exists for tactile feedback switches and assemblies which do not use a printed circuit board.

SUMMARY

The present disclosure relates to sealed soft switch assemblies including snap domes and the like.

According to an aspect of the present disclosure, a sealed soft switch assembly is provided. The switch assembly includes a holder defining at least a pair of eyelets extending completely therethrough; an electrically conductive lead-frame supported on the holder, the lead-frame defining at least a pair of openings therein, each opening being aligned with a respective eyelet formed in the holder; and at least a pair of electrically conductive rivets each configured and adapted for at least partial positioning in a respective eyelet, each rivet including a stem portion and a head portion. The first opening of the lead-frame is larger than the head portion of a first rivet such that the head portion of the first rivet does not contact the lead-frame, and the second opening of the lead-frame is smaller than the head portion of another rivet such that the head portion of the other rivet contacts the lead-frame. The switch assembly further includes at least one electrically conductive snap dome in electrical contact with the lead-frame and overlying the first rivet. In use, depressing the snap dome completes an electrical circuit between the first rivet and the second rivet through the lead-frame, and releasing the snap dome disconnects the electrical circuit.

The switch assembly further includes a flexible non-conductive cover configured and dimensioned to overlie at least the first snap dome. The switch assembly may further include an overmold configured and dimensioned to encase at least the holder, the lead-frame, the rivets, the snap dome, and the cover.

Desirably, an electrical wire is connectable to each of the rivets.

In an embodiment, the holder includes a recess formed in an upper surface thereof. The recess is configured and dimensioned to receive at least the lead-frame, the rivets and the snap dome therein. It is envisioned that a first opening of the lead-frame is larger than a second opening of the lead-frame.

In another embodiment, the holder defines at least three eyelets formed therein and extending completely therethrough. The lead-frame defines at least three openings therein, wherein the three openings are in registration with the three eyelets of the holder when the lead-frame is operatively connected to the holder. A first and a second opening of the lead-frame are each larger than a third opening of the lead-frame.

The switch assembly may further include at least three electrically conductive rivets each configured and adapted for at least partial positioning in a respective eyelet of the holder. Each rivet includes a stem portion and a head portion. A first opening and a second opening in the lead-frame are each larger than the head portion of a first and a second rivet such that the head portion of each first and second rivet does not contact the lead-frame. A third opening of the lead-frame is smaller than the head portion of a third rivet such that the head portion of the third rivet contacts the lead-frame.

The switch assembly may further include a pair of snap domes, wherein a first snap dome is in electrical contact with the lead-frame and overlies the first rivet, and wherein a second snap dome is in electrical contact with the lead-frame and overlies the second rivet. In use, depressing the first snap dome completes a first electrical circuit between the first rivet and the third rivet through the lead-frame and releasing the first snap dome disconnects the first electrical circuit. Additionally, in use, depressing the second snap dome completes a second electrical circuit between the second rivet and the third rivet through the lead-frame and releasing the second snap dome disconnects the second electrical circuit.

The switch assembly may further include a flexible non-conductive cover configured and dimensioned to overlie at least the first and second snap domes. The switch assembly may further include an overmold configured and dimensioned to encase at least the holder, the lead-frame, the rivets, the snap domes, and the cover. An electrical wire may be connected to each rivet. It is envisioned that the holder may include a recess formed in an upper surface thereof, wherein the recess is configured and dimensioned to receive at least the lead-frame, the rivets, and the snap domes therein.

According to another aspect of the present disclosure, a switch assembly connectable to electrical terminals of electrical wire leads is provided. The switch assembly includes a holder defining at least three eyelets formed therein and extending completely therethrough; an electrically conductive lead-frame supported on the holder, the lead-frame defining at least three openings therein, wherein the three openings are in registration with three eyelets of the holder when the lead-frame is operatively connected to the holder; and at least three electrically conductive rivets each configured and adapted for at least partial positioning in a respective eyelet of the holder. Each rivet includes a stem portion and a head portion. A first opening and a second opening in the lead-frame are each larger than the head portion of a first and a second rivet such that the head portion of each first and second rivet does not contact the lead-frame. A third opening of the lead-frame is smaller than the head portion of a third rivet such that the head portion of the third rivet contacts the lead-frame.

The switch assembly further includes a pair of electrically conductive snap domes, wherein a first snap dome is in electrical contact with the lead-frame and overlies the first rivet, and wherein a second snap dome is in electrical contact with the lead-frame and overlies the second rivet. In use, depressing the first snap dome completes a first electrical circuit between the first rivet and the third rivet through the lead-frame and releasing the first snap dome disconnects the first electrical circuit. Additionally, in use, depressing the second snap dome completes a second electrical circuit between the second rivet and the third rivet through the lead-frame and releasing the second snap dome disconnects the second electrical circuit.

The holder may include a recess formed in an upper surface thereof. The recess is configured and dimensioned to receive at least the lead-frame, the rivets, and the snap domes therein. The switch assembly further includes an overmold configured and dimensioned to encase at least the holder, the lead-frame, the rivets, the snap domes, and the cover.

For a better understanding of the present invention and to show how it may be carried into effect, reference will be made by way of example to the accompanying drawings.

DETAILED DESCRIPTION OF EMBODIMENTS

Figure 1:
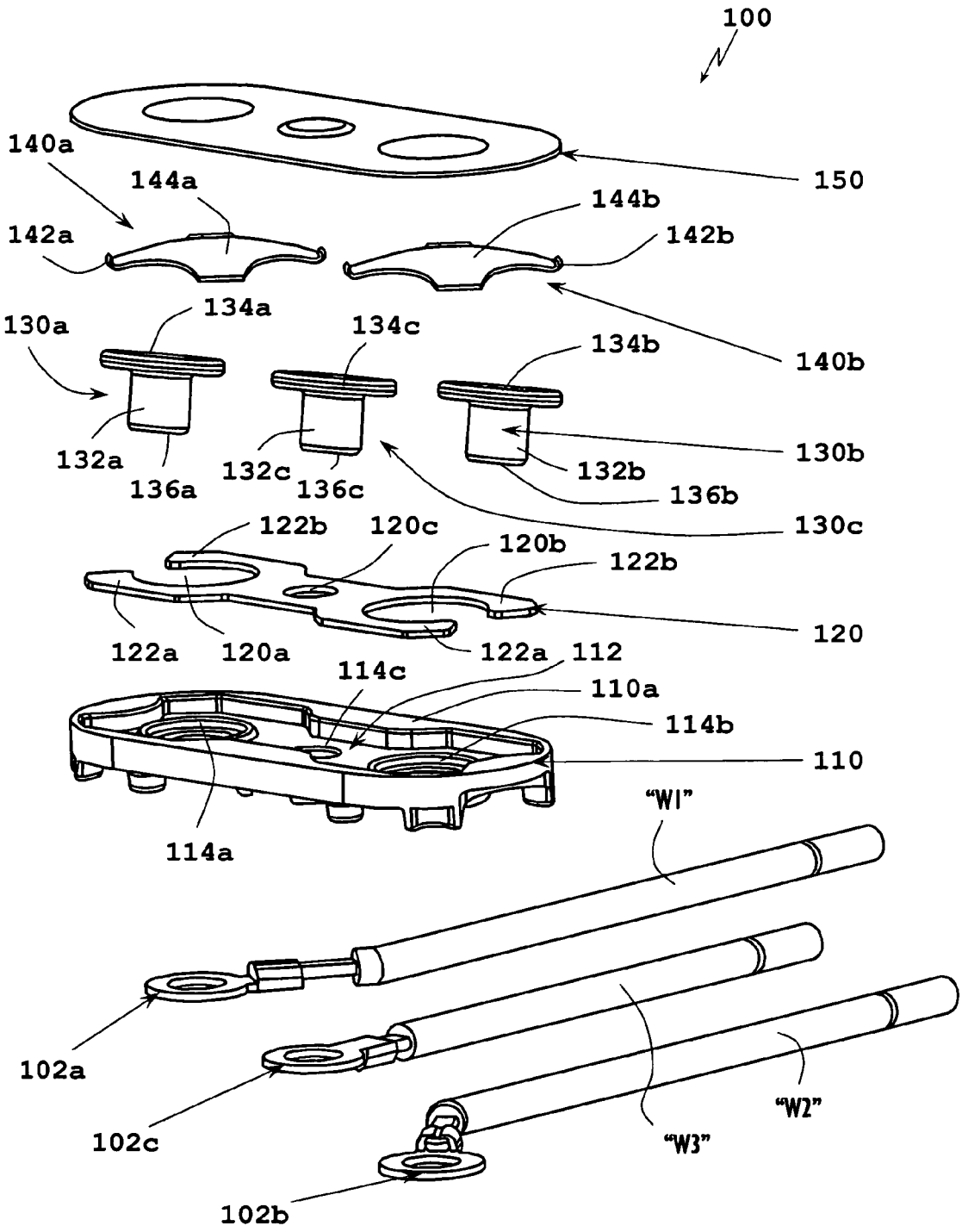
FIG. 1 is a perspective view, with parts separated, of a sealed soft switch assembly according to an embodiment of the present disclosure.
Figure 2:
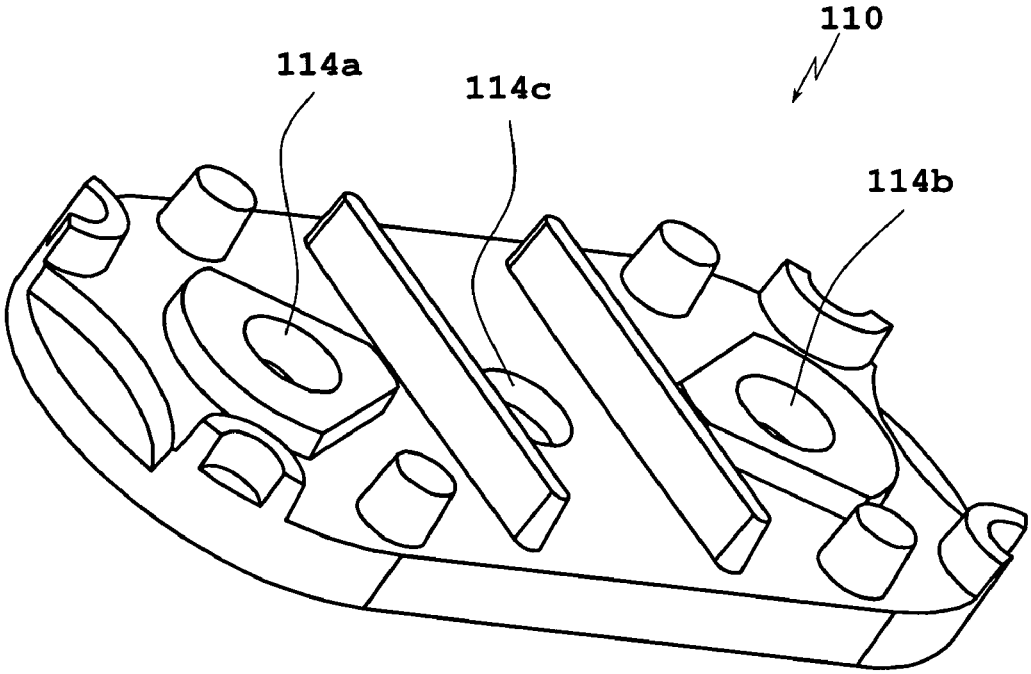
FIG. 2 is a bottom perspective view of the holder of the switch assembly of FIG. 1.

Embodiments of the presently disclosed sealed soft switch assembly will now be described in detail with reference to the drawing figures wherein like reference numerals identify similar or identical elements. As used herein and as is traditional, the term "distal" refers to that portion which is furthest from the user while the term "proximal" refers to that portion which is closest to the user. In addition, terms such as "above", "below", "forward", "rearward", etc. refer to the orientation of the figures or the direction of components and are simply used for convenience of description.

Referring initially to FIGS. 1–10, a sealed soft switch assembly in accordance with an embodiment of the present disclosure is generally designated as 100. Switch assembly 100 includes a holder 110 configured and adapted to operatively engage electrical terminals 102*a*, 102*b* and 102*c* of respective electrical wire leads "W1, W2 and W3", a lead-frame 120 disposed within holder 110, rivets 130*a*–130*c* operatively disposed within holder 110, snap domes 140*a*, 140*b* operatively disposed within holder 110 and overlying a first and a third rivet 130*a*, 130*b*, respectively, and a cover 150 operatively disposed within holder 110 and overlying at least the snap domes 140*a*, 140*b*.

As seen in FIGS. 1–3, 6 and 7, holder 110 defines a recess 112 formed in an upper surface 10*a* thereof. Recess 112 is configured and dimensioned to receive lead-frame 120, rivets 130*a*–130*c*, and snap domes 140*a*, 140*b* therein. Holder 110 includes a plurality of eyelets 114*a*–114*c* formed in recess 112 and extending completely therethrough. Desirably, a first or right side eyelet 114*a* and a second or left side eyelet 114*b* are stepped, e.g., configured and dimensioned for insertion of stem portions 132*a*, 132*b* of respective rivets 130*a*, 130*b* and to enable respective head portions 134*a* and 134*b* of rivets 130*a*, 130*b* to be recessed therein. Meanwhile, central eyelet 114*c* is configured and dimensioned to solely receive stem portion 132*c* of rivet 130*c*.

Desirably, holder 110 is fabricated from an electrically insulative or non-conductive material.

Figure 7:
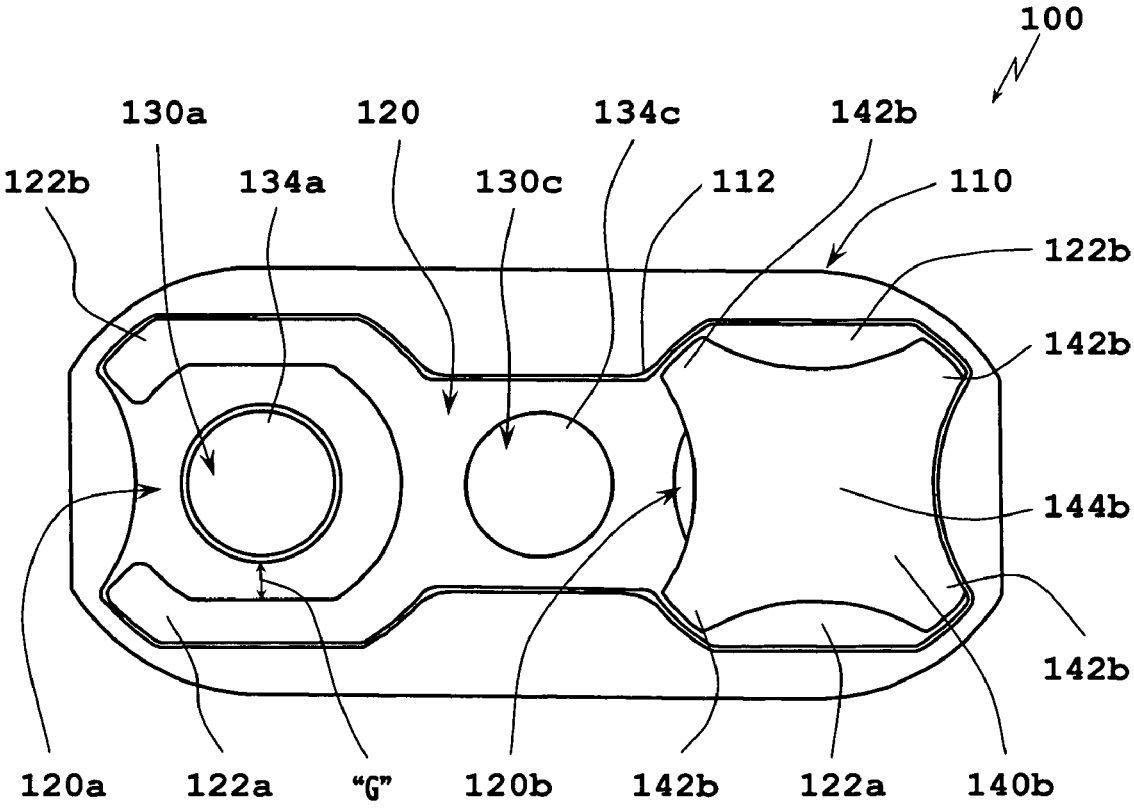
FIG. 7 is a top plan view of the switch assembly of FIGS. 1–6, illustrating several components thereof in an assembled condition.
Figure 6:
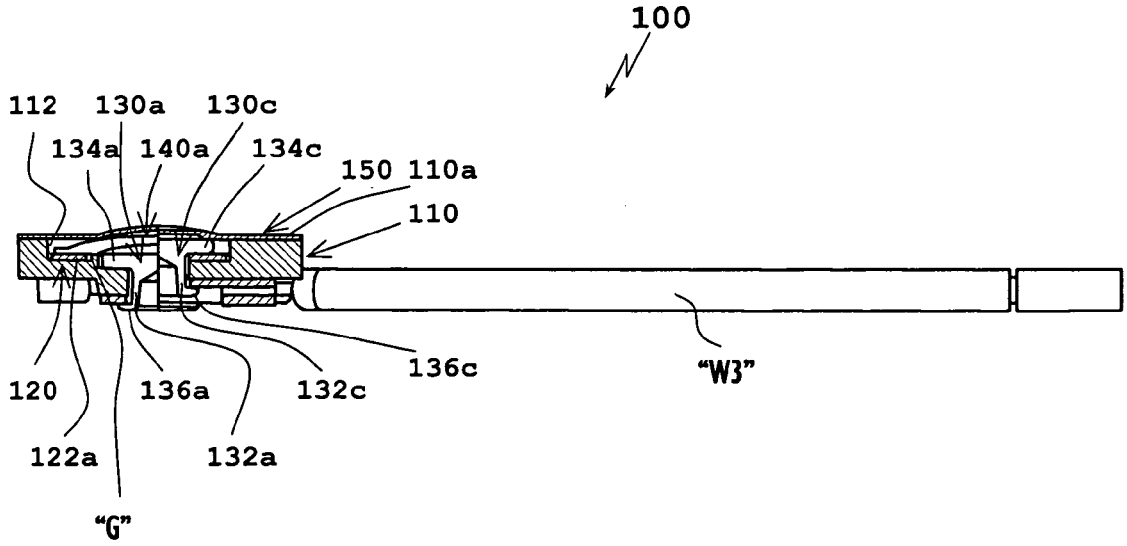
FIG. 6 is a cross-sectional view of the switch assembly of FIGS. 1–5, as taken through 6—6 of FIG. 5.

As seen in FIGS. 1, 6 and 7, lead-frame 120 is substantially planar and is fabricated for electrically conductive material. Lead-frame 120 is configured and dimensioned for placement in recess 112 of holder 110. Lead-frame 120 includes a plurality of openings 120*a*–120*c* formed therein and/or defined thereby. Desirably, when lead-frame 120 is positioned within recess 112 of holder 110, each opening 120*a*–120*c* aligns with or registers with a respective eyelet 114*a*–114*c* of holder 110.

With continued reference to FIGS. 1, 6 and 7, lead-frame 120 includes a first or right side opening 120*a*, and a second or left side opening 120*b*. Each of right side and left side openings 120*a*, 120*b*, respectively, is defined by a pair of arms 122*a*, 122*b*. Each of right side and left side openings 120*a*, 120*b*, respectively, is configured and dimensioned to be larger than the size of head portions 134*a*, 134*b* of respective rivets 130*a*, 130*b*. In this manner, when lead-frame 120 and rivets 130*a*, 130*b* are disposed within holder 110, a space or gap "G" (see FIGS. 6 and 7) is defined around and between arms 122*a*, 122*b* and head portions 134*a*, 134*b*. Lead-frame 120 includes a third or central opening 120*c* configured and dimensioned to solely receive stem portion 132*c* of central rivet 130*c*. Accordingly, head portion 134*c* of central rivet 130*c* rests atop lead-frame 120.

As will be described in greater detail below, when snap domes 140*a*, 140*b* are placed in recess 112 of holder 110, snap domes 140*a*, 140*b* overlie and are in operative registration with a respective first and second rivet 130*a*, 130*b*, and rest upon or are in electrical contact with arms 122*a*, 122*b* of lead-frame 120.

Figure 3:
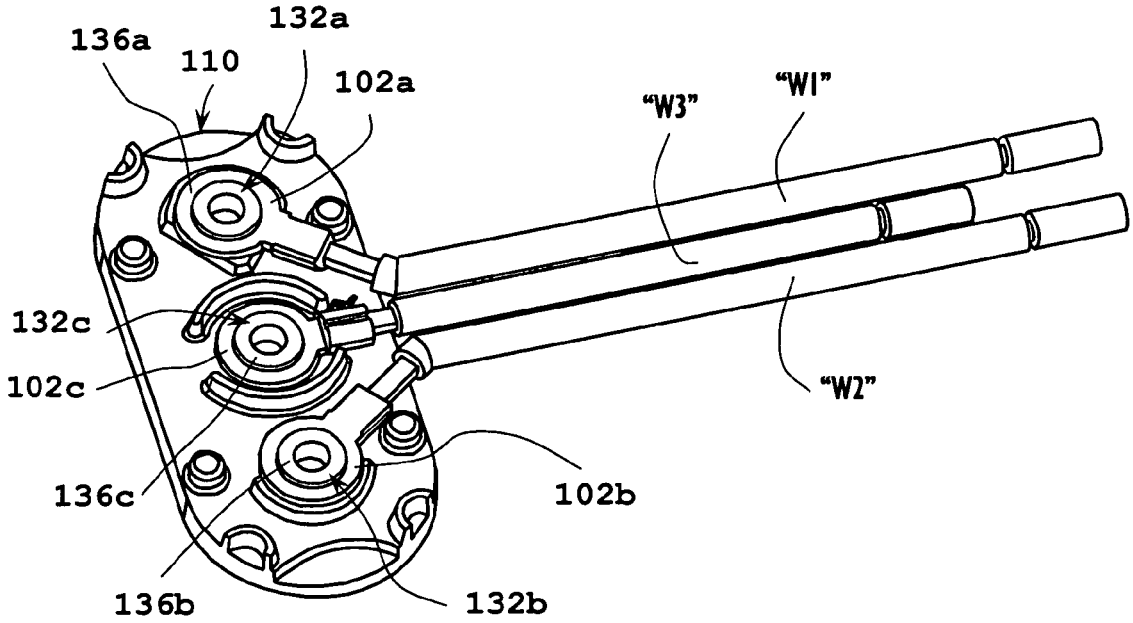
FIG. 3 is a bottom perspective view of the holder of FIG. 2 illustrating the connection of terminals thereto.
Figure 4:
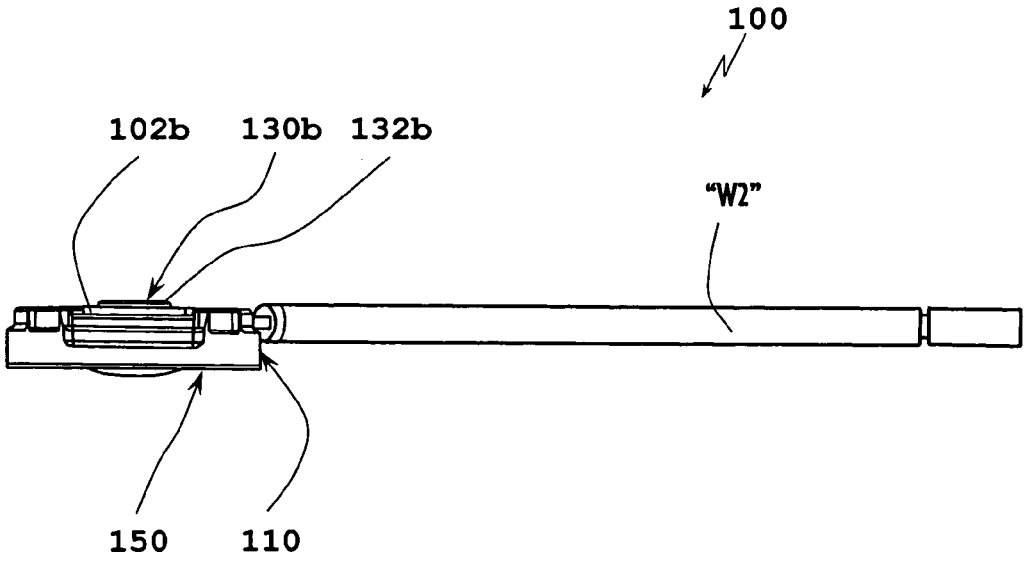
FIG. 4 is a side elevational view of the switch assembly of FIG. 1.
Figure 5:
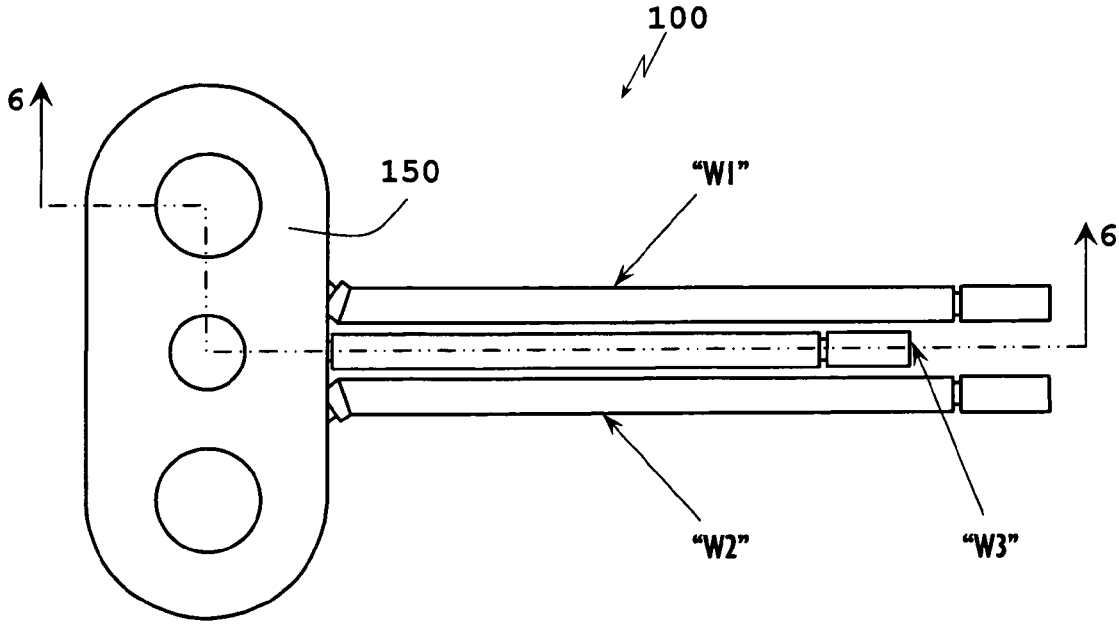
FIG. 5 is a top plan view of the switch assembly of FIG. 1.

As seen in FIGS. 1, 3, 4 and 6, each rivet 130*a*–130*c* includes a respective stem portion 132*a*–132*c*, and a respective enlarged head portion 134*a*–134*c*. As mentioned above, stem portions 132*a*–132*c* of rivets 130*a*–130*c* are configured and adapted to extend through respective eyelets 114*a*–114*c* by an amount sufficient to electrically engage respective electrical terminals 102*a*–102*c* of electrical wire leads "W1–W3", as seen in FIGS. 3 and 4. Rivets 130*a*–130*c* function to secure electrical terminals 102*a*–102*c* thereto and to create an electrical connection therewith. Desirably, each end 136*a*–136*c* of rivets 130*a*–130*c* is flared radially outward (see FIGS. 3 and 6) following passage of stem 132*a*–132*c* through electrical terminals 102*a*–102*c*. By crimping rivets 130*a*–130*c* in such a manner, the need to solder electrical terminals 102*a*–102*c* to a printed circuit board (not shown) is eliminated.

As seen in FIGS. 1, 6 and 7, each snap dome 140*a*, 140*b* includes contact pads or feet 142*a*, 142*b*, respectively, and a raised central region 144*a*, 144*b*, respectively. Each snap dome 140*a*, 140*b* is operatively disposed over a respective first and second rivet 130*a*, 130*b* when placed in recess 112 of holder 110. Each snap dome 140*a*, 140*b* is desirably fabricated from an electrically conductive material and configured so that when depressed, a predetermined range of motion is evident to the user (e.g., a tactile feedback) through a snap phase for closing the electrical circuit. The user develops a tactile "feel" through the range of motion and during activation of switch 100 when depressed.

In use, when snap dome 140*a* or 140*b* is depressed, the respective central region 144*a*, 144*b* of snap dome 140*a* or 140*b* contacts a respective rivet 130*a*, 130*b* and completes an electrical circuit between a respective first or second rivet 130*a* or 130*b* and lead-frame 120. In particular, if first snap dome 140*a* is depressed an electrical circuit or electrical current path is established between first wire lead "W1", through first rivet 130*a*, through lead-frame 120, through third rivet 130*c*, to third wire lead "W3". Similarly, if second snap dome 140*b* is depressed an electrical circuit or electrical current path is established between second wire lead "W2", through second rivet 130*b*, through lead-frame 120, through third rivet 130*c*, to third wire lead "W3".

As seen in FIGS. 1 and 4–6, a cover 150, fabricated from an electrically insulative or non-conductive pliable or flexible material may be provided to overlie snap domes 140*a*, 140*b* and protect the user from electrical shock during the use of switch 100 and to reduce the chances of snap domes 140*a*, 140*b* from becoming contaminated.

Figure 8:
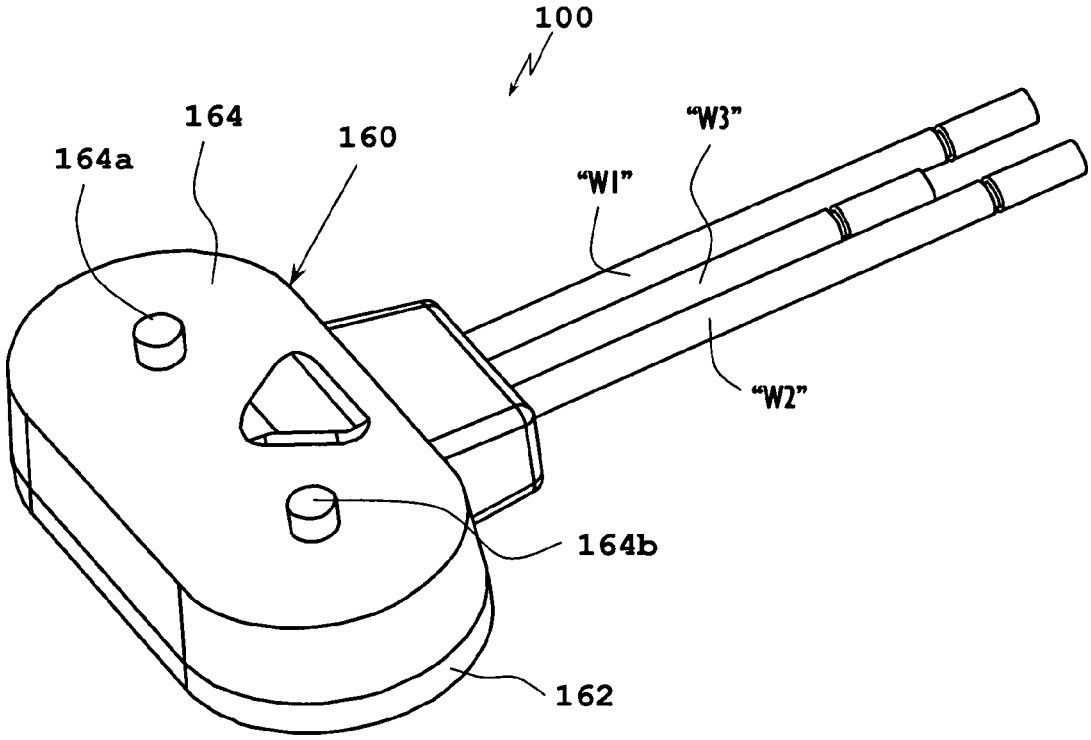
FIG. 8 is a perspective view of the switch assembly of FIGS. 1–7, shown with the overmold operatively associated therewith.
Figure 9:
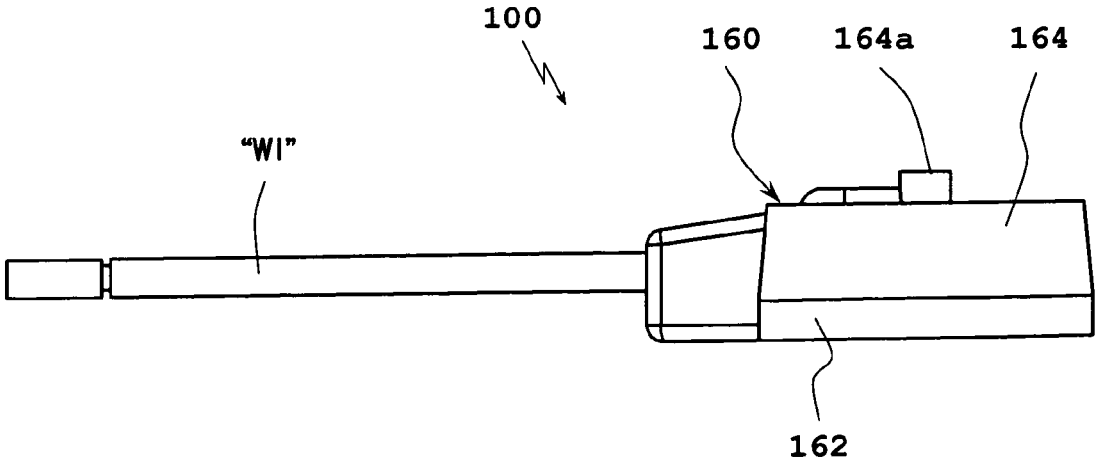
FIG. 9 is a side elevational view of the switch assembly of FIGS. 1–8.

As seen in FIGS. 8 and 9, switch 100 may include an overmold 160 configured and adapted to surround, enclose and/or encase terminals 102*a*–102*c*, holder 110, lead-frame 120, rivets 130*a*–130*c*, snap domes 140*a*, 140*b* and cover 150. Desirably, overmold 160 is fabricated from a resilient, flexible polymeric material or the like. Overmold 160 includes a bottom half-section 162 and a top half-section 164. Top half-section 164 may include a pair of nubs 164*a*, 164*b* located substantially over respective snap domes 140*a*, 140*b*. In this manner, by pressing down on a nub 164*a*, 164*b* a respective snap dome 140*a*, 140*b* is depressed and/or actuated. Overmold 160 desirably forms a fluid tight enclosure for the contents therein.

Turning now to FIGS. 10–15, a sealed soft switch assembly, in accordance with another embodiment of the present disclosure, is generally designated as 200. Switch assembly 200 is similar to switch assembly 100 and will only be discussed in detail to the extent necessary to identify differences in construction and operation.

Switch assembly 200 includes a holder 210 configured and adapted to operatively engage electrical terminals 102*a*, 102*b* of respective electrical wire leads "W1, W2", a lead-frame 220 disposed within holder 210, rivets 230*a*, 230*b* operatively disposed within holder 210, a snap dome 240 operatively disposed within holder 210 and overlying a first rivet 230*a*, and a cover 250 operatively disposed within holder 210 and overlying at least snap dome 240 and rivets 230*a*, 230*b*.

Figure 10:
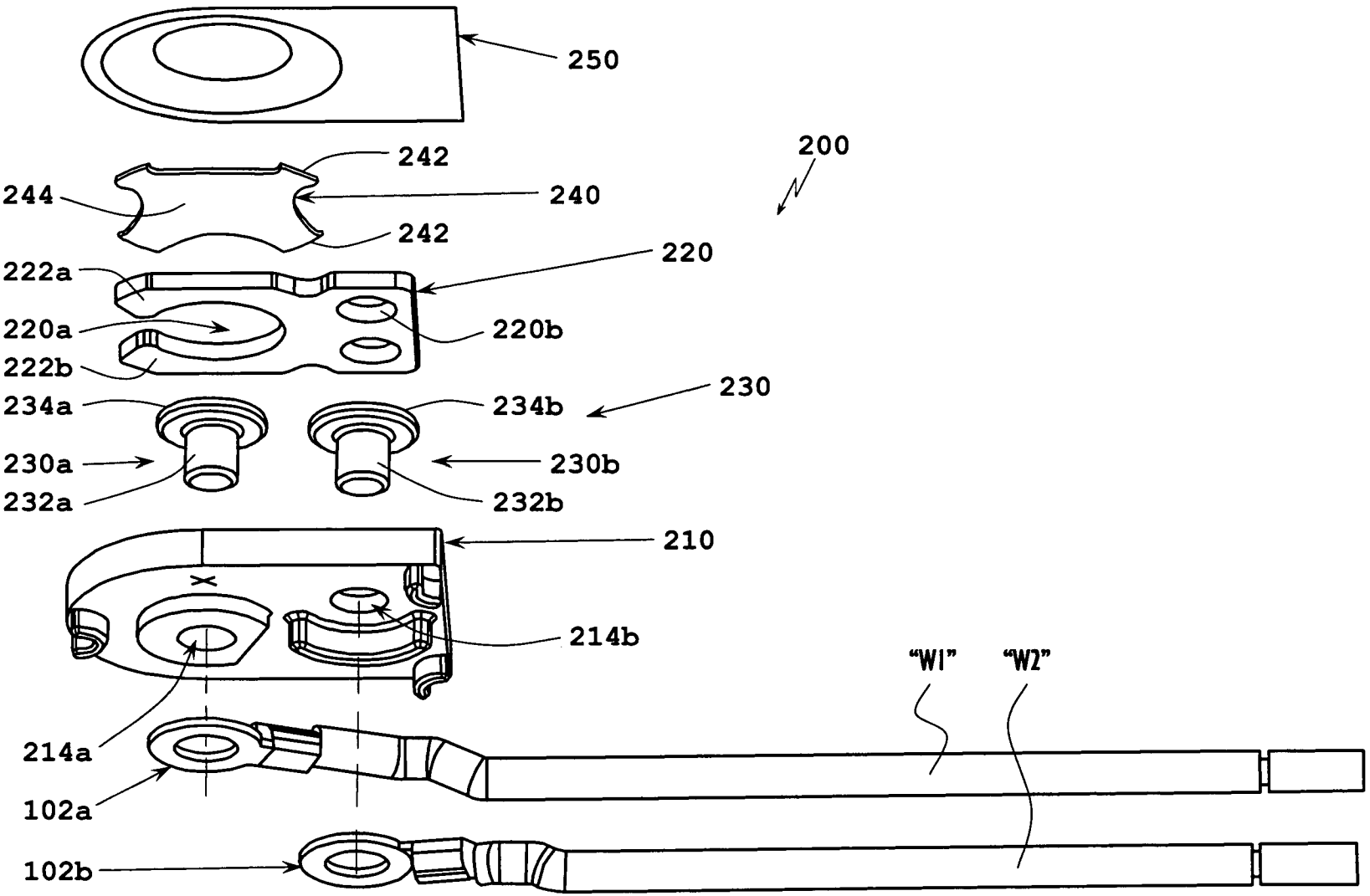
FIG. 10 is a perspective view, with parts separated, of a sealed soft switch assembly according to another embodiment of the present disclosure.
Figure 11:
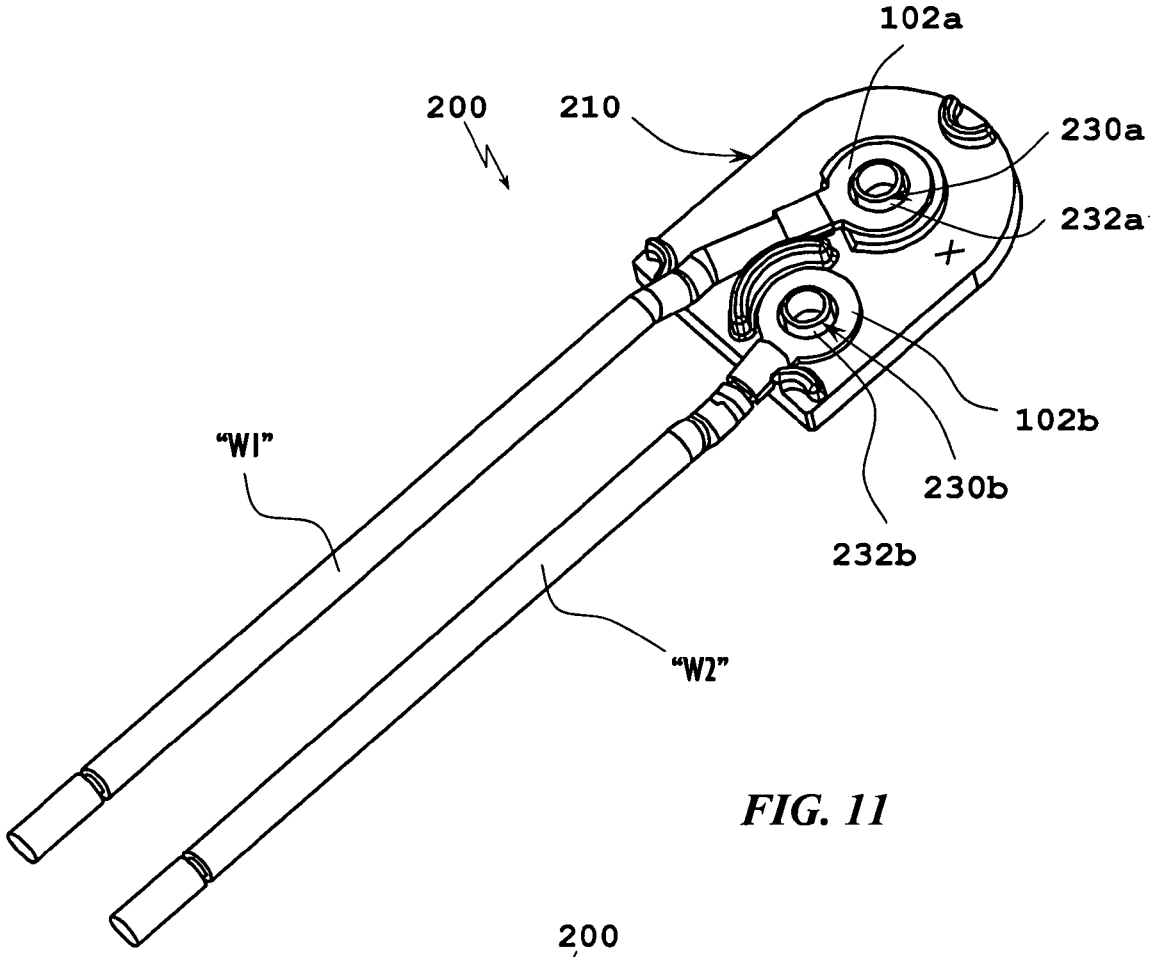
FIG. 11 is a bottom perspective view of a holder of the switch assembly of FIG. 10, illustrating the connection of terminals thereto.

As seen in FIGS. 10 and 11, holder 210 includes a recess (not shown) formed in an upper surface thereof which is configured and dimensioned to receive lead-frame 220, rivets 230*a*, 230*b*, and snap dome 240 therein. Holder 210 includes a pair of eyelets 214*a*, 214*b* formed in the recess thereof and extending completely therethrough. Desirably, a first eyelet 214*a* is stepped, e.g., configured and dimensioned for insertion of stem portion 232*a* of rivet 230*a* and to enable head portion 234*a* of rivet 230*a* to be recessed therein. Meanwhile, second eyelet 214*b* is configured and dimensioned to solely receive stem portion 232*b* of rivet 230*b*.

As seen in FIG. 10, lead-frame 220 is substantially planar and is fabricated for electrically conductive material. Lead-frame 220 is configured and dimensioned for placement in the recess defined in holder 210. Lead-frame 220 includes at least a pair of openings 220*a*, 220*b* formed therein and/or defined thereby. Desirably, when lead-frame 220 is positioned within the recess of holder 210, openings 220*a*, 220*b* align with or register with a respective eyelet 214*a*, 214*b* of holder 210.

With continued reference to FIG. 10, lead-frame 220 includes a first opening 220*a* defined by a pair of arms 222*a*, 222*b*. First opening 220*a* is configured and dimensioned to be larger than the size of head portion 234*a* of rivet 230*a*. In this manner, when lead-frame 220 and rivet 230*a* is disposed within holder 210, a space or gap (similar to gap "G" shown in FIGS. 6 and 7) is defined around and between arms 222*a*, 222*b* and head portion 234*a*. Lead-frame 220 includes a second opening 220*b* configured and dimensioned to solely receive stem portion 232*b* of second rivet 230*b*. Accordingly, head portion 234*b* of second rivet 230*b* rests atop lead-frame 220.

As will be described in greater detail below, when snap dome 240 is placed in the recess of holder 210, snap dome 240 overlies and is in operative registration with a first rivet 230*a*, and rests upon or is in electrical contact with arms 222*a*, 222*b* of lead-frame 220.

Figure 12:
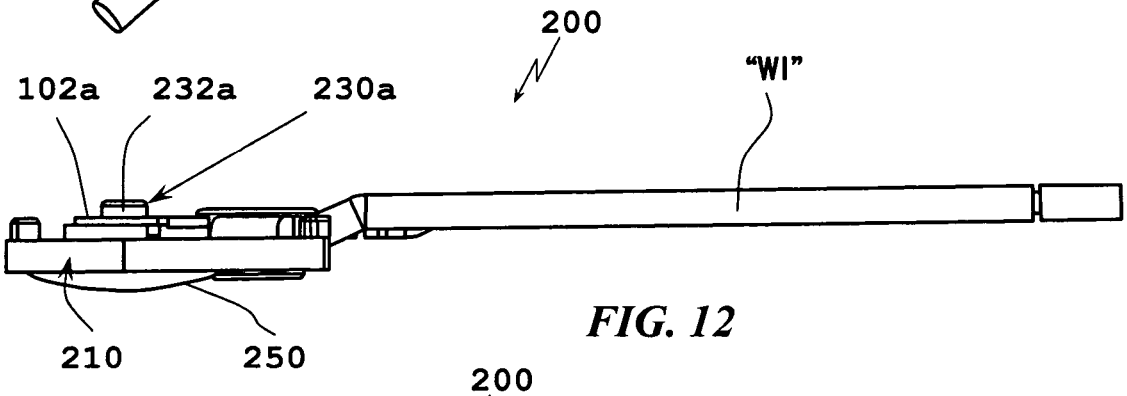
FIG. 12 is a side elevational view of the switch assembly of FIG. 10.
Figure 13:
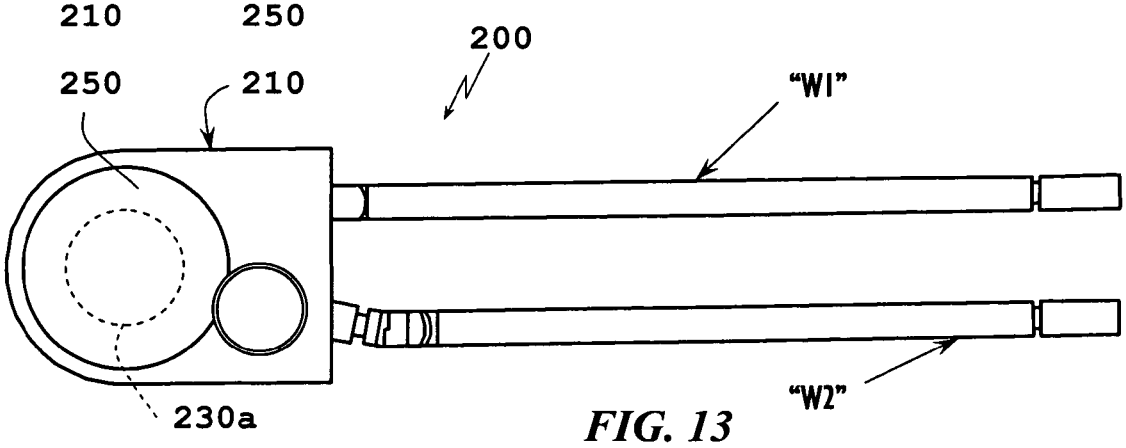
FIG. 13 is a top plan view of the switch assembly of FIG. 10.

As seen in FIG. 10, each rivet 230*a*, 230*b* includes a respective stem portion 232*a*, 232*b*, and a respective enlarged head portion 234*a*, 234*b*. As mentioned above, stem portions 232*a*, 232*b* of rivets 230*a*, 230*b* are configured and adapted to extend through respective eyelets 214*a*, 214*b* by an amount sufficient to electrically engage respective electrical terminals 202*a*, 202*b* of electrical wire leads "W1, W2", as seen in FIGS. 11 and 12. Rivets 230*a*, 230*b* function to secure electrical terminals 202*a*, 202*b* thereto and to create an electrical connection therewith.

As seen in FIG. 10, snap dome 240 includes contact pads or feet 242, and a raised central region 244. Snap dome 240 is operatively disposed over first rivet 230*a* when placed in the recess of holder 210. In use, when snap dome 240 is depressed, the central region 244 of snap dome 240 contacts first rivet 230*a* and completes an electrical circuit between first rivet 230*a* and lead-frame 220. In particular, when snap dome 240 is depressed an electrical circuit or electrical current path is established between first wire lead "W1", through first rivet 230*a*, through lead-frame 220, through second rivet 230*b*, to second wire lead "W2".

As seen in FIGS. 10 and 12, a cover 250, fabricated from an electrically insulative or non-conductive pliable or flexible material may be provided to overlie snap dome 240 and protect the user from electrical shock during the use of switch 200 and to reduce the chances of snap dome 240 from becoming contaminated.

Figure 14:
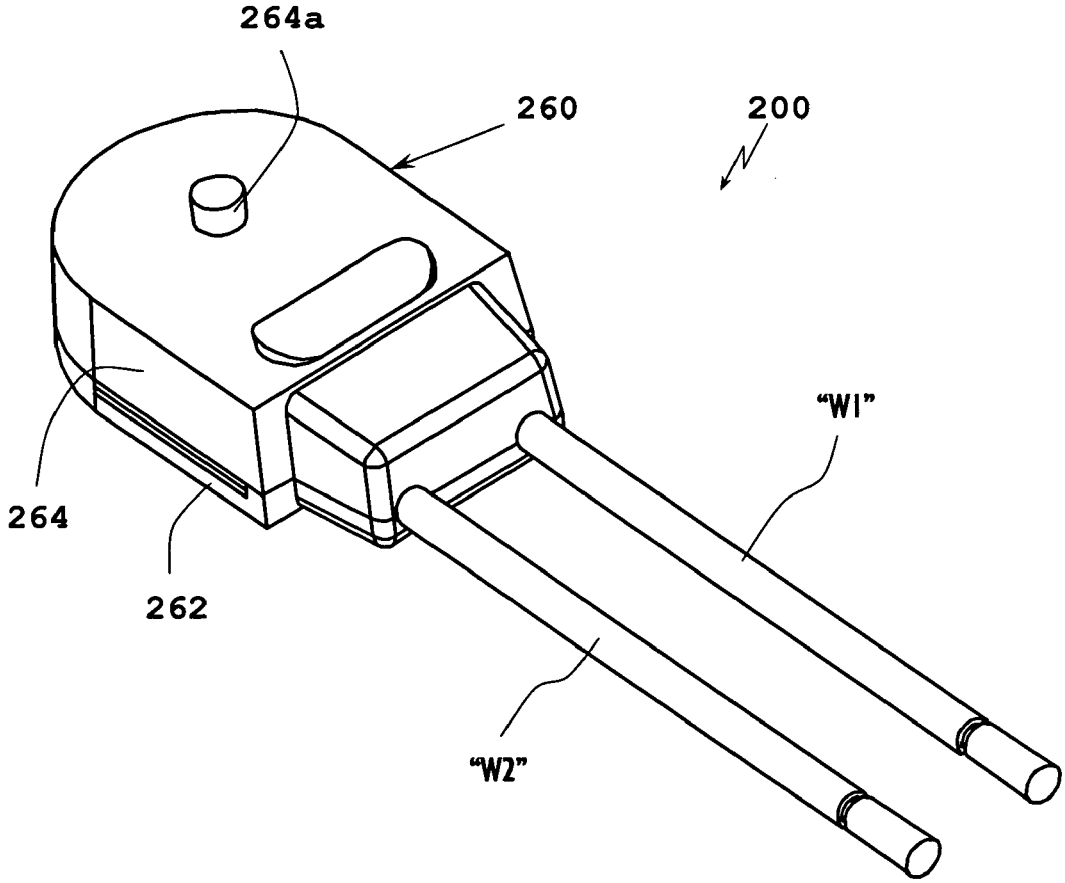
FIG. 14 is a perspective view of the switch assembly of FIGS. 10, 12 and 13, shown with the overmold operatively associated therewith.
Figure 15:
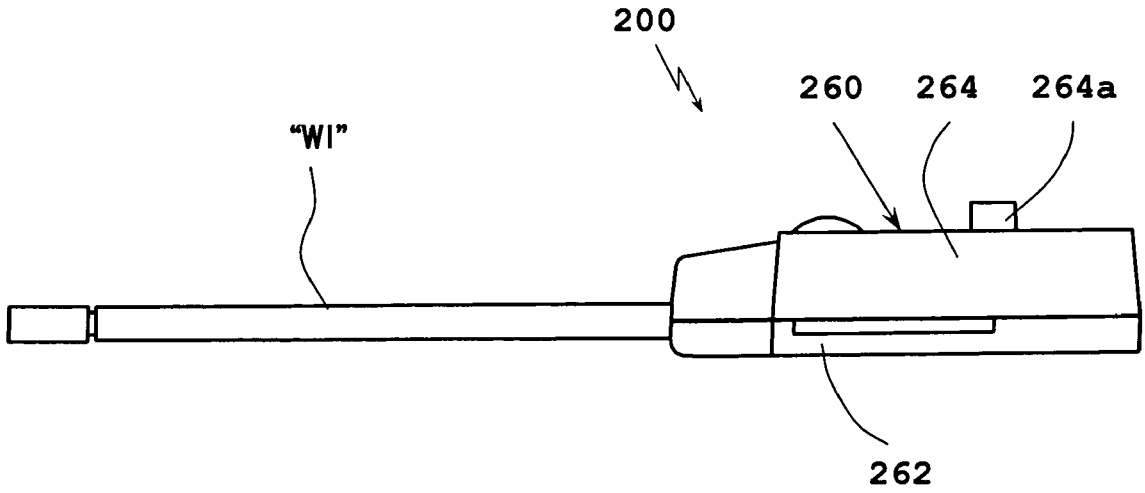
FIG. 15 is a side elevational view of the switch assembly of FIG. 14.

As seen in FIGS. 14 and 15, switch 200 may include an overmold 260 configured and adapted to surround, enclose and/or encase terminals 102*a* and 102*b*, holder 210, lead-frame 220, rivets 230*a* and 230*b*, snap dome 240, and cover 250. Desirably, overmold 260 is fabricated from a resilient, flexible polymeric material or the like. Overmold 260 includes a bottom half-section 262 and a top half-section 264. Top half-section 264 may include a nub 264*a* located substantially over snap dome 240. In this manner, by pressing down on nub 264*a* snap dome 240 is depressed and/or actuated. Overmold 260 desirably forms a fluid tight enclosure for the contents therein.

It is to be understood that the foregoing description is merely a disclosure of particular embodiments and is no way intended to limit the scope of the invention. Other possible modifications will be apparent to those skilled in the art and all modifications will be apparent to those in the art and all modifications are to be defined by the following claims.

What is claimed is:

1. A switch assembly, comprising:

a holder defining at least a pair of eyelets extending completely therethrough;

an electrically conductive lead-frame supported on the holder, the lead-frame defining at least a pair of openings therein, each opening being aligned with a respective eyelet formed in the holder;

at least a pair of electrically conductive rivets each configured and adapted for at least partial positioning in a respective eyelet, each rivet including a stem portion and a head portion;

wherein a first opening of at least the pair of openings of the lead-frame is larger than the head portion of a first rivet such that the head portion of the first rivet does not contact the lead-frame, and a second opening of at least the pair of openings of the lead-frame is smaller than the head portion of another rivet such that the head portion of the other rivet contacts the lead-frame; and at least one electrically conductive snap dome in electrical contact with the lead-frame and overlying the first rivet;

wherein depressing the snap dome completes an electrical circuit between the first rivet and the second rivet through the lead-frame, and releasing the snap dome disconnects the electrical circuit.

2. The switch assembly according to claim 1, further comprising a flexible non-conductive cover configured and dimensioned to overlie at least the first snap dome.

3. The switch assembly according to claim 2, further comprising an overmold configured and dimensioned to encase at least the holder, the lead-frame, the rivets, the snap dome, and the cover.

4. The switch assembly according to claim 3, wherein at least one nub is provided on the overmold substantially over the snap dome.

5. The switch assembly according to claim 3, wherein an electrical wire is connectable to each of the rivets.

6. The switch assembly according to claim 1, wherein the holder includes a recess formed in an upper surface thereof, the recess being configured and dimensioned to receive at least the lead-frame, the rivets and the snap dome therein.

7. The switch assembly according to claim 1, wherein the holder defines at least three eyelets formed therein and extending completely therethrough.

8. The switch assembly according to claim 7, wherein the lead-frame defines at least three openings therein, wherein the three openings are in registration with the three eyelets of the holder when the lead-frame is operatively connected to the holder.

9. The switch assembly according to claim 8, wherein the first and the second openings of the lead-frame are each larger than a third opening of the lead-frame.

10. The switch assembly according to claim 9, further comprising at least three electrically conductive rivets each configured and adapted for at least partial positioning in a respective eyelet of the holder, each rivet including a stem portion and a head portion.

11. The switch assembly according to claim 10, wherein a third opening of the lead-frame is smaller than the head portion of a third rivet such that the head portion of the third rivet contacts the lead-frame.

12. The switch assembly according to claim 11, further comprising a pair of snap domes, wherein a first snap dome is in electrical contact with the lead-frame and overlies the first rivet, and wherein a second snap dome is in electrical contact with the lead-frame and overlies the second rivet.

13. The switch assembly according to claim 12, wherein depressing the first snap dome completes a first electrical circuit between the first rivet and the third rivet through the lead-frame and releasing the first snap dome disconnects the first electrical circuit; and wherein depressing the second snap dome completes a second electrical circuit between the second rivet and the third rivet through the lead-frame and releasing the second snap dome disconnects the second electrical circuit.

14. The switch assembly according to claim 13, further comprising a flexible non-conductive cover configured and dimensioned to overlie at least the first and second snap domes.

15. The switch assembly according to claim 14, further comprising an overmold configured and dimensioned to encase at least the holder, the lead-frame, the rivets, the snap domes, and the cover.

16. The switch assembly according to claim 15, wherein an electrical wire is connected to each rivet.

17. The switch assembly according to claim 16, wherein the holder includes a recess formed in an upper surface thereof, the recess being configured and dimensioned to receive at least the lead-frame, the rivets, and the snap domes therein.

18. A switch assembly connectable to electrical terminals of electrical wire leads, the switch assembly comprising:

a holder defining at least three eyelets formed therein and extending completely therethrough;

an electrically conductive lead-frame supported on the holder, the lead-frame defining at least three openings therein, wherein the three openings are in registration with three eyelets of the holder when the lead-frame is operatively connected to the holder;

at least three electrically conductive rivets each configured and adapted for at least partial positioning in a respective eyelet of the holder, each rivet including a stem portion and a head portion;

wherein a first opening and a second opening in the lead-frame are each larger than the head portion of a first and a second rivet such that the head portion of each first and second rivet does not contact the lead-frame, and a third opening of the lead-frame is smaller than the head portion of a third rivet such that the head portion of the third rivet contacts the lead-frame; and a pair of electrically conductive snap domes, wherein a first snap dome is in electrical contact with the lead-frame and overlies the first rivet, and wherein a second snap dome is in electrical contact with the lead-frame and overlies the second rivet;

wherein depressing the first snap dome completes a first electrical circuit between the first rivet and the third rivet through the lead-frame and releasing the first snap dome disconnects the first electrical circuit; and wherein depressing the second snap dome completes a second electrical circuit between the second rivet and the third rivet through the lead-frame and releasing the second snap dome disconnects the second electrical circuit.

19. The switch assembly according to claim 18, wherein the holder includes a recess formed in an upper surface thereof, the recess being configured and dimensioned to receive at least the lead-frame, the rivets, and the snap domes therein.

20. The switch assembly according to claim 19, further comprising an overmold configured and dimensioned to encase at least the holder, the lead-frame, the rivets, the snap domes, and the cover.

* * * * *